United States Patent [19]

Tyler

[11] Patent Number: 4,840,312

[45] Date of Patent: Jun. 20, 1989

[54] SPRINKLER NOZZLE MODULE

[75] Inventor: Stephen L. Tyler, Diamond Bar, Calif.

[73] Assignee: The Toro Company, Minneapolis, Minn.

[21] Appl. No.: 123,420

[22] Filed: Nov. 20, 1987

[51] Int. Cl.[4] ..... B05B 15/10

[52] U.S. Cl. ..... 239/205; 239/391; 239/513; 239/600

[58] Field of Search ..... 239/203, 204, 205, 206, 239/390, 391, 512, 513, 600, DIG. 1

[56] References Cited

U.S. PATENT DOCUMENTS

| | | | |
|---|---|---|---|
| 1,084,094 | 1/1914 | Loosen . | |
| 1,492,941 | 5/1924 | Sherman et al. . | |
| 1,788,492 | 1/1931 | Nelson | 239/512 |
| 1,805,782 | 5/1931 | Munz . | |
| 1,862,812 | 6/1932 | Thompson | 239/203 |
| 2,253,979 | 8/1941 | De Lacy-Mulhall . | |
| 2,270,595 | 1/1942 | Lewis | 239/DIG. 1 |
| 2,611,644 | 9/1952 | Burdick | 239/204 |
| 2,650,132 | 8/1953 | Reinecke . | |
| 3,035,778 | 5/1962 | Kimbro et al. | 239/204 |
| 3,149,784 | 9/1964 | Skidgel . | |
| 3,266,730 | 8/1966 | Martini | 239/205 |
| 3,301,489 | 1/1967 | Tropeano et al. | 239/204 |
| 3,334,817 | 8/1967 | Miller et al. | 239/206 |
| 3,655,132 | 4/1972 | Rosic . | |
| 4,347,979 | 9/1982 | Mathews . | |
| 4,624,412 | 11/1986 | Hunter | 239/205 |

*Primary Examiner*—Andres Kashnikow
*Assistant Examiner*—Michael J. Forman
*Attorney, Agent, or Firm*—R. Lawrence Buckley

[57] ABSTRACT

A sprinkler (10) including a riser assembly (14) and a removable nozzle module (34) operatively connected thereto. Nozzle module (34) includes a nozzle holder (36) and a nozzle (38). Nozzle holder (36) is accessible even when sprinkler (10) is buried and the riser assembly (14) is completely retracted. In a preferred embodiment, a bayonet fit exists between nozzle module (34) and riser assembly (14) so that it is only necessary to twist nozzle module (34) a few degrees to disconnect it from riser assembly (14). Once nozzle module (34) is removed, nozzle (38) can be replaced or unplugged as necessary.

1 Claim, 2 Drawing Sheets

SPRINKLER NOZZLE MODULE

TECHNICAL FIELD

The invention relates generally to turf sprinklers and more particularly to pop-up sprinklers and nozzles therefor.

BACKGROUND OF THE INVENTION

Sprinkler systems for turf irrigation are well known. The typical system includes a plurality of valves and sprinkler heads in fluid communication with a water source, and a centralized controller connected to the water valves. At appropriate times the controller opens the normally-closed valves to allow water to flow from the water source to the sprinkler heads. Water then issues from the sprinkler heads in predetermined fashion.

There are many different types of sprinkler heads, including above-the-ground heads and "pop-up" heads. Pop-up sprinklers, though generally more complicated and expensive than other types of sprinklers, are thought to be superior. There are several reasons for this. For example, a pop-up sprinkler's nozzle opening is typically covered when the sprinkler is not in use and is therefore less likely to be partially or completely plugged by debris or insects. Also, when not being used a pop-up sprinkler is entirely below the surface and out of the way. As the present invention is primarily directed toward pop-up heads, the remaining discussion will focus on this type of sprinkler.

The typical pop-up sprinkler head includes a stationary body and a "riser" which extends vertically upward, or "pops up," when water is allowed to flow to the sprinkler. The riser is in the nature of a hollow tube which supports a nozzle at its upper end. When the normally-closed valve associated with a sprinkler opens to allow water to flow to the sprinkler, two things happen: (i) water pressure pushes against the riser to move it from its retracted to its fully extended position, and (ii) water flows axially upward through the riser, and the nozzle receives the axial flow from the riser and turns it radially to create a radial stream. A spring or other type of resilient element is interposed between the body and the riser to continuously urge the riser toward its retracted, subsurface, position, so that when water pressure is removed the riser will immediately proceed from its extended to its retracted position.

The riser of a pop-up sprinkler head can remain rotationally stationary or can include a portion which rotates in continuous or oscillatory fashion to water a circular or semicircular area, respectively. More specifically, the riser of the typical pop-up rotary sprinkler includes a first portion which does not rotate and a second portion which rotates relative to the first (non-rotating) portion. The present invention will be described in terms of a pop-up sprinkler of the rotating type, although those skilled in the art will recognize that the invention could be advantageously applied to any type of pop-up sprinkler.

The rotating portion of a pop-up sprinkler riser typically carries a nozzle at its uppermost end. Several different nozzle sizes are usually available so that the appropriate flow rate can be selected for any given water pressure. Although nozzles have historically been installed in the risers by manufacturers, they are usually configured so that they can be removed in the field. Nozzle removal is necessary to permit flushing of the water lines following initial installation. Also, it may be necessary to unplug the sprinkler nozzles should they become clogged with debris, or to replace a nozzle which has been internally worn by abrasives (e.g., sand) in the water. Nozzle abrasion is a real problem whenever well water is used for irrigation. Some of the northeastern states and Florida particularly suffer from this problem. Finally, a nozzle may be replaced simply to achieve a different water flow rate. This may be necessary if the water pressure changes significantly, or if it is desirable to change the sprinkling pattern or coverage.

Prior art pop-up sprinklers, although generally satisfactory for their intended use, included nozzles which were difficult to remove, however. One would typically have to grasp the riser and pull it out of the sprinkler body against a significant spring force. Then, while holding the riser in its extended position, the nozzle would be removed. This process was repeated in reverse to replace the nozzle. When a large number of nozzles had to be replaced this procedure became overly burdensome.

For example, U.S. Pat. No. 3,655,132, issued to R. F. Rosic, discloses a rotary pop-up sprinkler which includes a nozzle block removably pinned to the riser assembly. While the Rosic rotary sprinkler is desirable in that it permits removal and replacement of the nozzle module without having to replace the entire riser assembly or sprinkler head, it is disadvantageous due to the fact that the nozzle module cannot be removed without first pulling the riser assembly out of the sprinkler body. Also see U.S. Pat. No. 2,253,979, issued to P. De Lacy-Mulhall, which discloses a sprinkler head of the pop-up rotary type. The nozzles of this sprinkler appear to be replaceable, but in order to access the nozzles the riser must be extended.

One prior art sprinkler addresses the nozzle removal problem, however. U.S. Pat. No. 3,149,784, issued to J. R. Skidgel, discloses a pop-up rotary sprinkler having nozzles which are seemingly removable through holes in the cover plate. Thus, the Skidgel sprinkler design apparently avoids the problem of having to manually extend the riser to change the nozzles. However, Skidgel's nozzles are continually exposed to the elements, and can be clogged by debris and/or insects.

The present invention is directed toward the problem of removal of the nozzle from a pop-up sprinkler. More particularly, the present invention permits removal of a nozzle without extending the riser, but at the same time protects the nozzle when the riser is retracted within the sprinkler body.

SUMMARY OF THE INVENTION

Accordingly, a preferred embodiment of the invention is a pop-up sprinkler including a body; a riser having retracted and extended states relative to the body; and a removable nozzle module operatively connected to the riser. The nozzle module includes a nozzle, the opening of which is completely covered when the riser is in its retracted state. Further, the nozzle module can be removed when the riser is in its retracted state.

Preferably, the nozzle module connects to the riser in bayonet fashion. Further, preferably the nozzle module includes a nozzle holder which receives the nozzle and the nozzle holder is accessible when the riser is in its retracted state. In a preferred embodiment, the uppermost lid of the nozzle holder forms apertures suitable for receiving a tool. The tool can be used to apply torque to the nozzle holder so that the nozzle module can be readily removed and inserted.

Additional features and aspects of the invention are shown and discussed below with reference to the Drawing.

BRIEF DESCRIPTION OF THE DRAWING

The invention will be further described with reference to the Drawing, wherein.

DETAILED DESCRIPTION OF THE INVENTION

Figure 1:
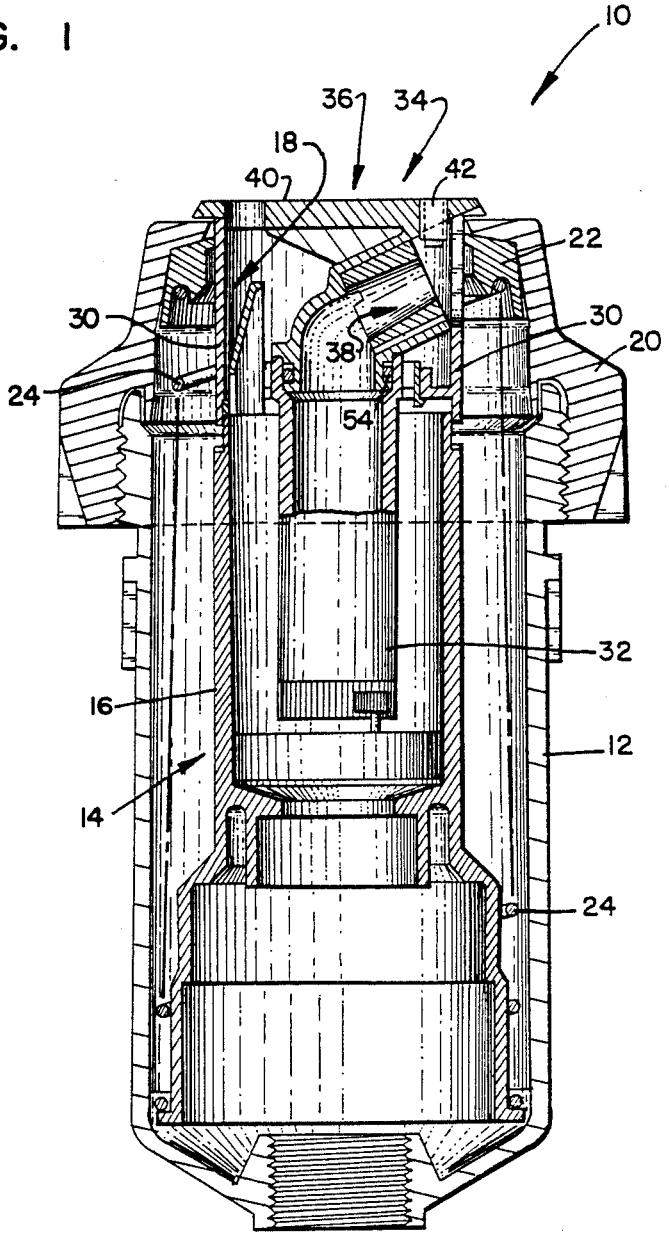
FIG. 1 is a sectional view of a preferred pop-up sprinkler according to the invention, including a removable nozzle module.

With reference to the Drawing, wherein like reference numerals designate like parts and assemblies throughout the several views, FIG. 1 shows a sectional view of a preferred sprinkler 10 according to the invention. Sprinkler 10 is a rotary pop-up sprinkler generally of the type sold by The Toro Company, assignee herein, under the designation "Super 606." It includes a tubular body 12 having female threads at its lower end to receive a male threaded pipe which extends from a water valve (not shown) which in turn is in fluid communication with a central water source (not shown). The valve (not shown) is turned on at appropriate times to supply water to sprinkler 10.

Concentrically located within tubular body 12 of sprinkler 10 is a riser assembly 14 having a lower non-rotating riser portion 16 and an upper rotating riser portion 18. Riser assembly 14 has a retracted position illustrated in FIG. 1 and an extended position wherein riser assembly 14 vertically extends from body 12.

A ring-like cap 20 threadedly attaches to the top of body 12. Cap 20, as shown in FIG. 1, actually forms several toroidal cavities. In its uppermost cavity cap 20 retains a flexible wiper seal 22. As is well known, wiper seal 22 substantially prevents water, debris and insects from interfering with the operation of sprinkler 10. Bearing against the bottom of wiper seal 22 is a compression spring 24, and the bottom of compression spring 24 bears down on the non-rotating riser portion 16. When the normally-closed water valve (not shown) associated with sprinkler 10 opens, water pressure causes riser assembly 14 to move from its retracted position to its extended position against the force of compression spring 24. Conversely, when the water valve closes, and the water pressure drops, riser assembly 14 is forced downward by spring 24 into its retracted position.

The rotating portion 18 of riser assembly 14 includes a cup-like upper portion 30 and an integral relatively long tubular lower section 32 extending downward therefrom. As diagrammatically shown in FIG. 1, the lower tip of section 32 is coupled to a drive mechanism which causes the entire riser portion 18 to rotate relative to the non-rotating riser portion 16 when water courses through sprinkler 10. Cup-like portion 30 receives, in bayonet (quarter turn) fashion, a nozzle module 34 which includes a nozzle holder 36 and a nozzle insert 38. Nozzle holder 36 is preferably a single piece of molded plastic, e.g., acetal resin. Nozzle 38, preferably made of molded plastic, e.g., acetal, fits within an aperture formed by holder 36. It should be noted that it isn't necessary that nozzle module 34 comprise two separate parts; nozzle holder 36 and nozzle 38 could in fact be integral with one another. As further described below, nozzle module 34 can be inserted into and removed from rotating riser portion 18 even when riser assembly 14 is in its fully retracted position (as depicted in FIG. 1). Nozzle 38 aligns with a slot or notch in the vertical wall of cup-like portion 30.

Figure 4:
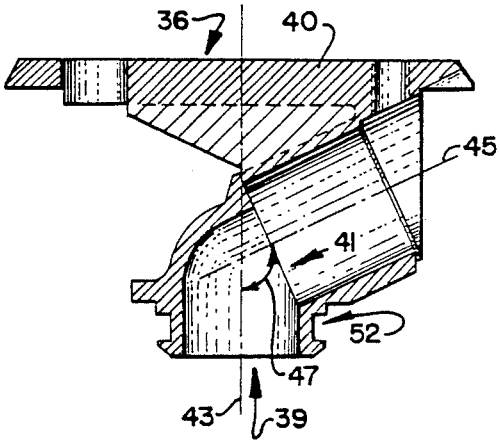
FIG. 4 is an enlarged sectional view of the nozzle holder portion of the nozzle module of FIG. 2.

Nozzle holder 36 includes an upper lid 40 which forms a threaded aperture suitable for receiving a set screw 42. Set screw 42 can be vertically adjusted so that its lowermost tip interferes with the smooth flow of water from nozzle 38 so as to cause a portion of the water jet to cover the inner extent of the circle being irrigated. Referring to FIG. 4, nozzle holder 36 also forms a curved conduit 37 which has a circular inlet 39 and a circular outlet 41. The imaginary longitudinal axis 43 of inlet 39 is oriented vertically when sprinkler 10 is installed. Imaginary axis 45 through outlet 41 forms an angle 47 of about 115° with axis 43. It should be noted that angle 47 could actually be adjustable so that the "throw" of the sprinkler (trajectory of the water) could be varied. The preferred inside diameter of conduit 37 is about 0.40 inch.

Figure 2:
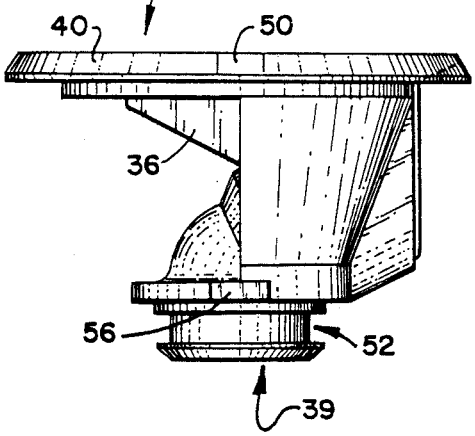
FIG. 2 is an enlarged side elevational view of a preferred nozzle module according to the invention.

FIG. 2 shows a side elevational view of nozzle module 34. A pair of tool notches 50, spaced 180° apart, are formed in the outer periphery of lid 40. Notches 50 receive a pin wrench (not shown) which can be used to apply torque to nozzle module 34 so that it can be inserted and removed as necessary. The bottommost portion of nozzle holder 36, adjacent inlet 39, forms a toroidal O-ring seat 52 suitable for receiving an O-ring 54 (see FIG. 1). O-ring 54 acts as a seal between conduit 37 and the rotating portion 18 of riser assembly 14. Water flows upward through riser assembly 14 and into conduit 37, which turns the flow radially. Nozzle 38 receives the flow from conduit outlet 41 and conditions it to produce a smooth high velocity jet capable of covering a considerable distance.

Figure 3:
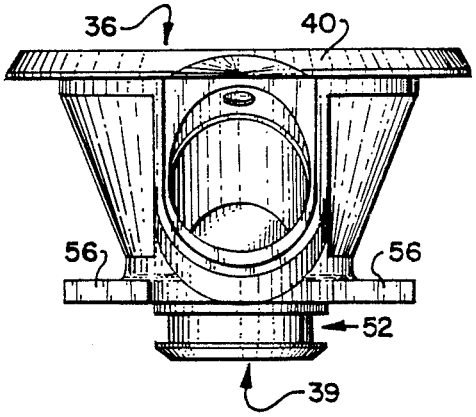
FIG. 3 is a front elevational view of the nozzle holder portion of the nozzle module of FIG. 2.
Figure 5:
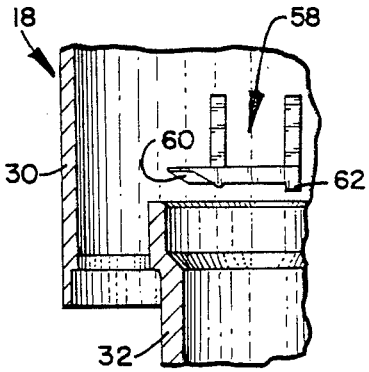
FIG. 5 is a detailed partial view of the riser of the sprinkler of FIG. 1, showing one of the tabs suitable for receiving the nozzle module in bayonet fashion.

As shown in FIG. 3, a pair of wings 56 extend radially outward from nozzle holder 36 immediately above O-ring seat 52. Wings 56 are designed to engage tabs 58 (see FIG. 5) which extend radially inward from the cup-like upper portion 30 of riser assembly 14. For the sake of clarity, tabs 58 are not shown in FIG. 1; one tab 58 is shown in detail in FIG. 5, however. Each tab 58 includes a wedge-shaped leading edge 60 suitable for forcing the associated wing 56 of nozzle holder 36 downward as nozzle holder 36 is twisted. Each tab 58 also includes a stop 62 which extends downward from the end of the tab opposite from the end forming leading edge 60. After a predetermined angular twist of nozzle module 34, wings 56 engage stops 62. Thus, module 34 can be inserted and removed with only a quarter turn or less. As is well known, this type of connection is commonly called a "bayonet" connection. Of course, other connection techniques (e.g., threaded connection) could be employed. The connection scheme must allow for removal and insertion of module 34 from the top, with riser assembly 14 in its retracted position. Also, nozzle 38 should preferably assume a predetermined position when module 34 is locked in place, so that it can align with the aperture in the wall of cup-like portion 30.

The operation of the invention can now be summarized. Assuming that sprinkler 10 is sold without a pre-installed nozzle module 34, once sprinkler 10 is installed the water lines can be flushed. Following the flushing operation nozzle module 34 is reinserted and needn't be removed unless nozzle 38 becomes plugged or unacceptably worn, or the available water pressure changes. If it is indeed necessary to remove module 34, a tool in the nature of a pin wrench (not shown) is used to engage notches 50 and apply torque to module 34. Module 34 is twisted until wings 56 escape tabs 58, at which time module 34 can be axially withdrawn. Nozzle 38 can be removed from nozzle holder 36 simply by withdrawing set screw 42 and inserting a puller within nozzle 38 to draw it out of holder 36. A new nozzle 38 can then be inserted; module 34 pushed and twisted into secure connection with riser assembly 14; and set screw 42 readjusted. It should particularly be noted that the opening formed by nozzle 38 is completely covered when riser assembly 14 is retracted, and therefore is not exposed or subject to debris, insects, and the like which tend to plug nozzles.

There are other modifications which will be apparent to those skilled in the art. Accordingly the scope of this invention will be limited only by the appended claims.

I claim:

1. A rotating pop-up sprinkler comprising:

(a) a tubular body suitable for connection to a water source;

(b) an elongate tubular riser assembly received within the body and in fluid communication therewith, comprising a lower non-rotating portion and an upper rotating portion rotatably coupled thereto, wherein the riser assembly has retracted and extended states relative to the body, and wherein the upper rotating portion of the riser assembly is cup-like and has a vertical cylindrical wall extending radially inward from which is a pair of diametrically opposed tabs each having a bottom surface;

(c) a ring-like cap threadedly attached to the top of the body having an annular upper rim;

(d) an annular wiper seal captured within the cap and in contact with and underside of the cap rim;

(e) a compression spring acting between on underside of the wiper seal and the non-rotating portion of the riser assembly for urging the riser assembly toward its retracted state; and (f) a removable nozzle module comprising a nozzle holder and a nozzle received thereby and in fluid communication therewith, wherein:

(i) the nozzle holder comprises an upper lid and a body wherein the body and the lid are integral one to the other; the body forms a nozzle aperture to receive the nozzle; and extending radially from the body is a pair of diametrically-opposed wings each having a top surface, the top surfaces of the wings being suitable for engagement with the bottom surfaces of the riser assembly tabs, whereby partial rotation of the nozzle holder relative to the rotating portion of the riser assembly effects engagement or disengagement of the top and bottom surfaces of the corresponding wings and tabs, respectively, depending on the direction of rotation, thereby resulting in a bayonet connection between the nozzle module and the rotating portion of the riser assembly;

(ii) the upper lid of the nozzle holder is accessible when the riser assembly is in its retracted state and the lid forms one or more apertures for receiving means for applying torque to the nozzle holder, whereby the nozzle module can be twisted relative to the non-rotating portion of the riser assembly and removed without extending the riser assembly; and (iii) the nozzle aperture is below the rim of the cap and is therefore covered and protected when the riser assembly is in its retracted state.

* * * * *